US009751276B2

(12) United States Patent
Kamiya et al.

(10) Patent No.: US 9,751,276 B2
(45) Date of Patent: Sep. 5, 2017

(54) SHEET BINDING DEVICE, POST-PROCESSING DEVICE, AND IMAGE FORMING SYSTEM

(71) Applicants: Tomoaki Kamiya, Yamanashi-ken (JP); Masayuki Kobayashi, Yamanashi-ken (JP)

(72) Inventors: Tomoaki Kamiya, Yamanashi-ken (JP); Masayuki Kobayashi, Yamanashi-ken (JP)

(73) Assignees: CANON FINETECH INC., Misato-shi, Saitama (JP); NISCA CORPORATION, Minamikoma-gun, Yamanashi-ken (JP)

( * ) Notice: Subject to any disclaimer, the term of this patent is extended or adjusted under 35 U.S.C. 154(b) by 90 days.

(21) Appl. No.: 14/678,584

(22) Filed: Apr. 3, 2015

(65) Prior Publication Data

US 2015/0283783 A1 Oct. 8, 2015

(30) Foreign Application Priority Data

Apr. 7, 2014 (JP) ..... 2014-078604
Apr. 7, 2014 (JP) ..... 2014-078605

(51) Int. Cl.
*B31F 5/02* (2006.01)
*B65H 37/04* (2006.01)
(Continued)

(52) U.S. Cl.
CPC ..... *B31F 5/02* (2013.01); *B31F 1/07* (2013.01); *B42F 3/00* (2013.01); *B42F 3/003* (2013.01);
(Continued)

(58) Field of Classification Search
CPC ..... B31F 1/07; B31F 5/02; B31F 2201/00; B31F 2201/0702; B31F 2201/0779;
(Continued)

(56) References Cited

U.S. PATENT DOCUMENTS 7,172,186 B2 2/2007 Saito et al.
7,296,793 B2 11/2007 Yoshino
(Continued)

FOREIGN PATENT DOCUMENTS

CN 1550929 A 12/2004
CN 1572693 A 2/2005
(Continued)

OTHER PUBLICATIONS

China Patent Office, "Office Action for Chinese Patent Application No. 201510161838.3," Sep. 2, 2016.

*Primary Examiner* — Leslie A Nicholson, III
(74) *Attorney, Agent, or Firm* — Manabu Kanesaka

(57) ABSTRACT

A sheet binding device includes a pressurizing unit that pressurizes a sheet bundle to bind the sheet bundle, a pressurizing section that is disposed in the pressurizing unit and configured to be moved from a waiting position separated from the sheet bundle to a pressurizing position at which the pressurizing section pressurizes the sheet bundle, a drive motor that actuates the pressurizing unit, and a controller that controls the drive motor such that the pressurizing section is engaged with the sheet bundle at a predetermined setting velocity.

12 Claims, 9 Drawing Sheets

Ta ; Pressurizing surface operation start
Tb ; First setting velocity
Tc ; Deceleration control start
Td ; Deceleration control end (pressurizing surface second setting velocity)
Te ; Pressurizing surface constant torque control (pressurizing surface holding state)
Tf ; Pressurizing surface return
Tg ; Pressurizing surface waiting position

(51) Int. Cl.
*B31F 1/07* (2006.01)
*B42F 3/00* (2006.01)

(52) U.S. Cl.
CPC ..... *B65H 37/04* (2013.01); *B31F 2201/00* (2013.01); *B31F 2201/0702* (2013.01); *B31F 2201/0774* (2013.01); *B31F 2201/0779* (2013.01); *B65H 2301/43828* (2013.01); *B65H 2301/51616* (2013.01); *B65H 2403/514* (2013.01); *B65H 2801/27* (2013.01); *G03G 2215/00852* (2013.01)

(58) Field of Classification Search
CPC ..... B31F 2201/0774; B65H 37/04; B65H 2301/51616; B42F 3/00; B42F 3/003; G03G 2215/00852
USPC ..... 270/58.08
See application file for complete search history.

(56) References Cited

U.S. PATENT DOCUMENTS

| | | | | |
|---|---|---|---|---|
| 7,690,637 | B2 | 4/2010 | Yamamoto | |
| 7,699,310 | B2 * | 4/2010 | Shirasaki | B65H 29/14 270/58.08 |
| 8,899,568 | B2 | 12/2014 | Matsushita et al. | |
| 2015/0203310 | A1 * | 7/2015 | Yamazaki | B65H 37/04 399/408 |

FOREIGN PATENT DOCUMENTS

| | | | |
|---|---|---|---|
| CN | 1886235 | A | 12/2006 |
| CN | 101234714 | A | 8/2008 |
| CN | 103359532 | A | 10/2013 |
| JP | H11-60045 | A | 3/1999 |
| JP | 2003-137477 | A | 5/2003 |
| JP | 2009208872 | A * | 9/2009 |
| JP | 2010-274623 | A | 12/2010 |
| JP | 2012-47940 | A | 3/2012 |

* cited by examiner

Cps; Waiting
Cpm; Pressurization start
Cpe; Pressurization end
Wp
Ap
S
Cps
Cpm
Cpe
30
31
32
33
33a
40
41
42
43
44

Ta ; Pressurizing surface operation start

Tb ; First setting velocity

Tc ; Deceleration control start

Td ; Deceleration control end (pressurizing surface second setting velocity)

Te ; Pressurizing surface constant torque control (pressurizing surface holding state)

Tf ; Pressurizing surface return

Tg ; Pressurizing surface waiting position

Data table stored in RAM

| | Sheet bundle thickness | | Number of sheets | | Sheet material | |
|---|---|---|---|---|---|---|
| Pressurizing time Tp | seg;A | seg;B | seg;A | seg;B | seg;A | seg;B |
| | time=01 | time=02 | time=03 | time=04 | time=05 | time=06 |
| | Thin → | Thick | Small → | Large | Fragile → | Stiff |
| | Short | Long | Short | Long | Short | Long |

SHEET BINDING DEVICE, POST-PROCESSING DEVICE, AND IMAGE FORMING SYSTEM

BACKGROUND OF THE INVENTION

Field of the Invention

The present invention relates to a sheet binding mechanism for binding sheets accumulated in a bundle and to improvement of a pressure-binding mechanism for pressure-bonding a plurality of sheets using a pressurizing member for binding.

Description of the Related Art

Generally, as a binding device of such a type, there are known a binding mechanism that binds a sheet bundle accumulated in an aligned state with a staple and a stapleless binding mechanism that pressure-bonds a sheet bundle using a press mechanism to deform the sheets of the sheet bundle for binding. The sheet bundle bound by the above stapleless binding mechanism is bound without a metal binder and the sheets can thus be separated from each other easily.

For example, Jpn. Pat. Appin. Laid-Open Publication No. 2012-47940 discloses a mechanism that accumulates, in a bundle, sheets conveyed from an image forming device while aligning them and pressure-bonds the sheet bundle using a pair of upper and lower pressurizing members for binding. This document discloses a mechanism that drives a fixed-side pressurizing member with a concave-convex surface and a movable-side pressurizing member with a projecting-and-recessed surface to be engaged with the concave-convex surface of the fixed-side pressurizing member while connecting them through a motion transmission mechanism such as a cam connected to a drive motor.

Further, Jpn. Pat. Appin. Laid-Open Publication No. 2010-274623 discloses a mechanism that presses a pressurizing lever (upper tooth-shaped member 60A in this document) axially supported so as to be swingable against a fixed member (lower tooth-shaped member) using a drive cam connected to a drive motor (stepping motor). In this case, pressing force for pressing the sheets is about 100 kgf.

OBJECT OF THE INVENTION

As described above, there is already known a mechanism that deforms a plurality of sheets stacked in a bundle so as to make the sheets be engaged with each other for binding by clamping with projecting-and-recessed surfaces. In such a mechanism, there occurs a need to pressurize the sheets with great force for binding a sheet bundle. Particularly, when the sheets are deformed by clamping the sheet bundle with the projecting-and-recessed surfaces, there occurs a need to plastically deform the sheet material by applying high pressure.

The above Jpn. Pat. Appin. Laid-Open Publication No. 2012-47940 discloses a pressurizing mechanism that makes the projecting-and-recessed shaped pressurizing members clamp the sheet bundle using a cam and a drive motor. However, a moving velocity of the pressurizing member when the sheet bundle and pressurizing member are brought into contact with each other is not controlled, so that a variation may occur in binding force due to a difference in a biting degree. An object of the present invention is to provide a sheet binding device capable of performing stable binding processing.

BRIEF SUMMARY OF THE INVENTION

To solve the above problem, a sheet binding device according to the present invention includes: a pressurizing unit that pressurizes a sheet bundle to bind the sheet bundle; a pressurizing section that is disposed in the pressurizing unit and configured to be moved from a waiting position separated from the sheet bundle to a pressurizing position at which the pressurizing section pressurizes the sheet bundle; a drive motor that actuates the pressurizing unit; a transmission unit that changes rotation of the drive motor to the pressing force; and a controller that controls the drive motor such that the pressurizing section is engaged with the sheet bundle at a predetermined setting velocity.

According to the present invention, the drive motor is controlled such that an engagement velocity becomes a predetermined velocity until the pressurizing surface is engaged with the sheets. This suppresses a variation in the binding processing due to a difference in a biting degree to thereby enhance accuracy in the binding processing.

BRIEF DESCRIPTION OF THE SEVERAL VIEWS OF THE DRAWINGS

FIGS. 2A to 2C are explanatory views each explaining an operation state of the device of FIG. 1, in which FIG. 2A illustrates a binding processing waiting state, FIG. 2B illustrates a state where the binding processing is started, and FIG. 2C illustrates a state where the binding processing is ended;

FIGS. 3A to 3E are explanatory views for explaining a relationship between pressurizing surfaces and sheets during binding processing of FIGS. 2A to 2C, in which FIG. 3A illustrates a state where a pressurizing surface is in a waiting state, FIG. 3B illustrates a state where the pressurizing surface is moved at a high velocity, FIG. 3C illustrates a state where the pressurizing surface is engaged with the sheets at a low velocity, FIG. 3D illustrates a state where the pressurizing surface starts pressurizing the sheets and deforming the same, and FIG. 3E illustrates a state where the pressurizing surface ends the pressurization of the sheets;

FIGS. 4A to 4C are explanatory views of control for a drive motor performed by a controller, in which FIG. 4A is a velocity diagram, FIG. 4B is a conceptual view of velocity control for a DC (Direct Current) motor performed in an unloaded state, and FIG. 4C is a conceptual view of a state where the DC motor is controlled to a predetermined torque;

DETAILED DESCRIPTION OF THE INVENTION

Figure 1:
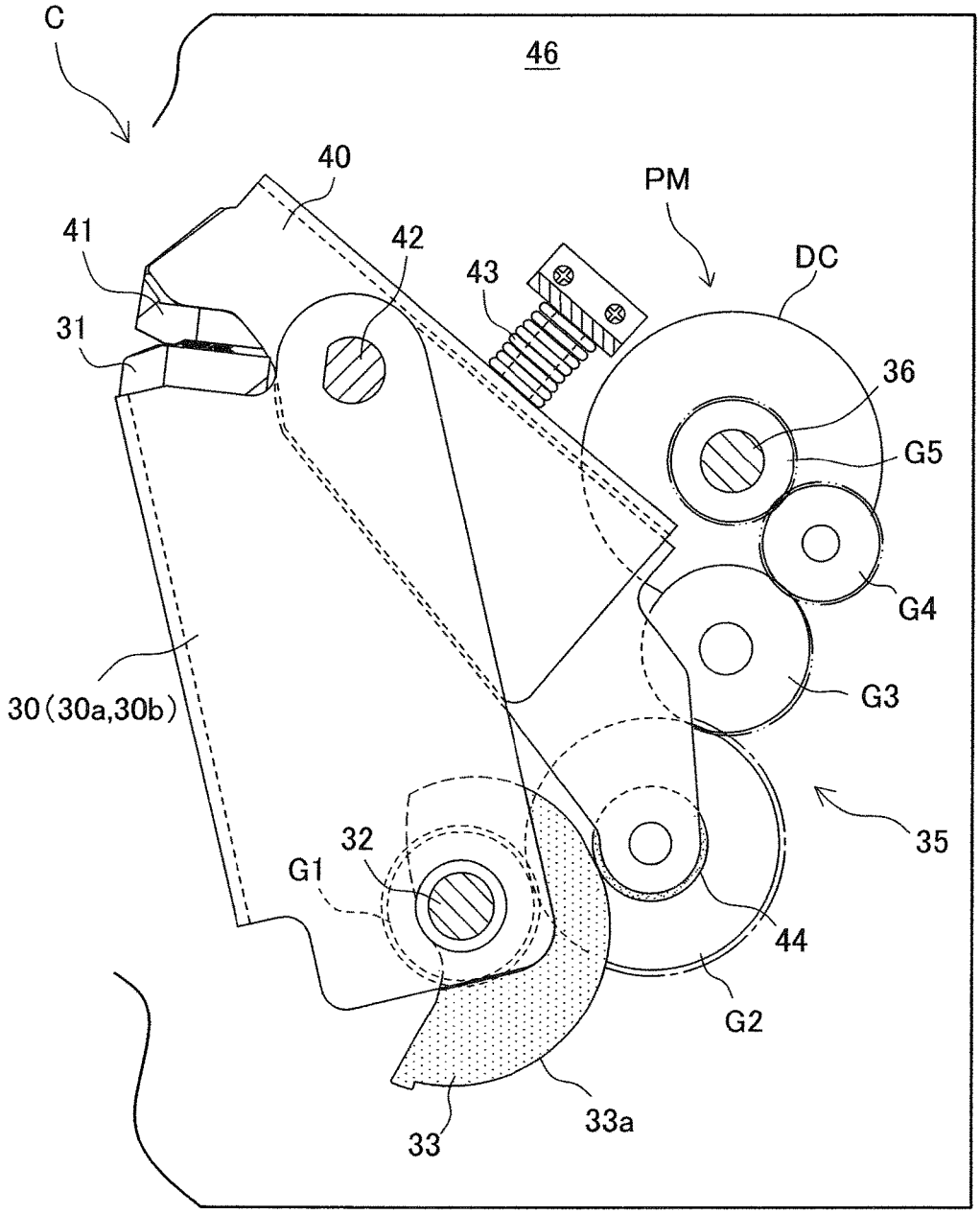
FIG. 1 is an explanatory view of an entire configuration of a binding unit (sheet binding device) according to the present invention.

The present invention will be described in detail below based on an illustrated preferred embodiment. The present invention relates to a binding unit (sheet binding device) C that binds a plurality of sheets, a post-processing device B using the binding unit C, and an image forming system A. Hereinafter, the binding unit C, the post-processing device B, and the image forming system A will be described in this order.

[Binding Unit]

The binding unit (sheet binding device) C according to the present invention will be described with reference to FIGS. 1 to 5A and 5B. The binding unit C pressurizes and deforms a plurality of sheets S accumulated in a bundle so as to make the sheets S be engaged with each other for binding. To this end, the binding unit C includes a clamp mechanism that clamps the sheets S so as to deform the same.

The clamp mechanism includes a pair of pressurizing surfaces 31 and 41 that clamp the bundled sheets S from front and rear sides, a pair of pressurizing members 30 and provided with the pressurizing surfaces 31 and 41, respectively, and a drive mechanism (drive unit) PM that moves one of the pressurizing surfaces of the respective pressurizing members from a waiting position Wp (non-pressurizing position) separated from the sheets S to a pressurizing position Ap at which the one pressurizing surface pressurizes the sheets S. More specifically, the clamp mechanism of FIG. 1 includes a fixed-side pressurizing member 30 having a fixed-side pressurizing surface 31, a movable-side pressurizing member 40 having a movable-side pressurizing surface 41, and a drive mechanism PM that moves the movable-side pressurizing surface 41 from a waiting position Wp (FIG. 2A) separated from the sheets S to a pressurizing position Ap (FIG. 2B) at which the movable-side pressure surface 41 pressurizes the sheets S.

The fixed-side pressurizing member 30 (hereinafter, referred to as "fixed member") and movable-side pressurizing member 40 (hereinafter, referred to as "movable member") are configured such that the sheet bundle S is clamped between the pressurizing surface 31 (hereinafter, referred to as "fixed surface") of the fixed member 30 on which the sheet bundle S is supported and the pressurizing surface 41 (hereinafter, referred to as "movable surface") of the movable member 40. To this end, the movable member 40 is axially supported so as to be swingable about a support shaft 42, and the support shaft 42 is fixed to the fixed member 30. The support shaft 42 may be fixed to another member such as a unit frame 46 in place of the fixed member 30.

The fixed member 30 is integrally fixed to the unit frame 46. Along with swinging motion of the movable member 40 about the support shaft 42, the movable surface 41 is moved between a pressurizing state (pressurizing position Ap, see FIG. 2B) at which the sheet bundle S is clamped between the fixed surface 31 and the movable surface 41 and a non-pressurizing state (waiting position Wp, see FIG. 2A) at which the movable surface 41 is separated from the sheet bundle S.

In the device illustrated in FIG. 1, the fixed member is formed of a frame member (metal, reinforced resin, etc.) having a U-like cross-section (channel shape), and the movable member 40 is supported between side walls 30*a* and 30*b* of the fixed member 30 so as to be swingable about the support shaft 42. Thus, the movable member 40 swings about the support shaft 42 while being guided by the side walls 30*a* and 30*b* of the fixed member 30. The movable member 40 has a return spring 43 that biases the movable member 40 to the waiting position side. The return spring 43 is disposed between the movable member 40 and unit frame 46 (or fixed member 30).

Figures 2A, 2B, 2C:
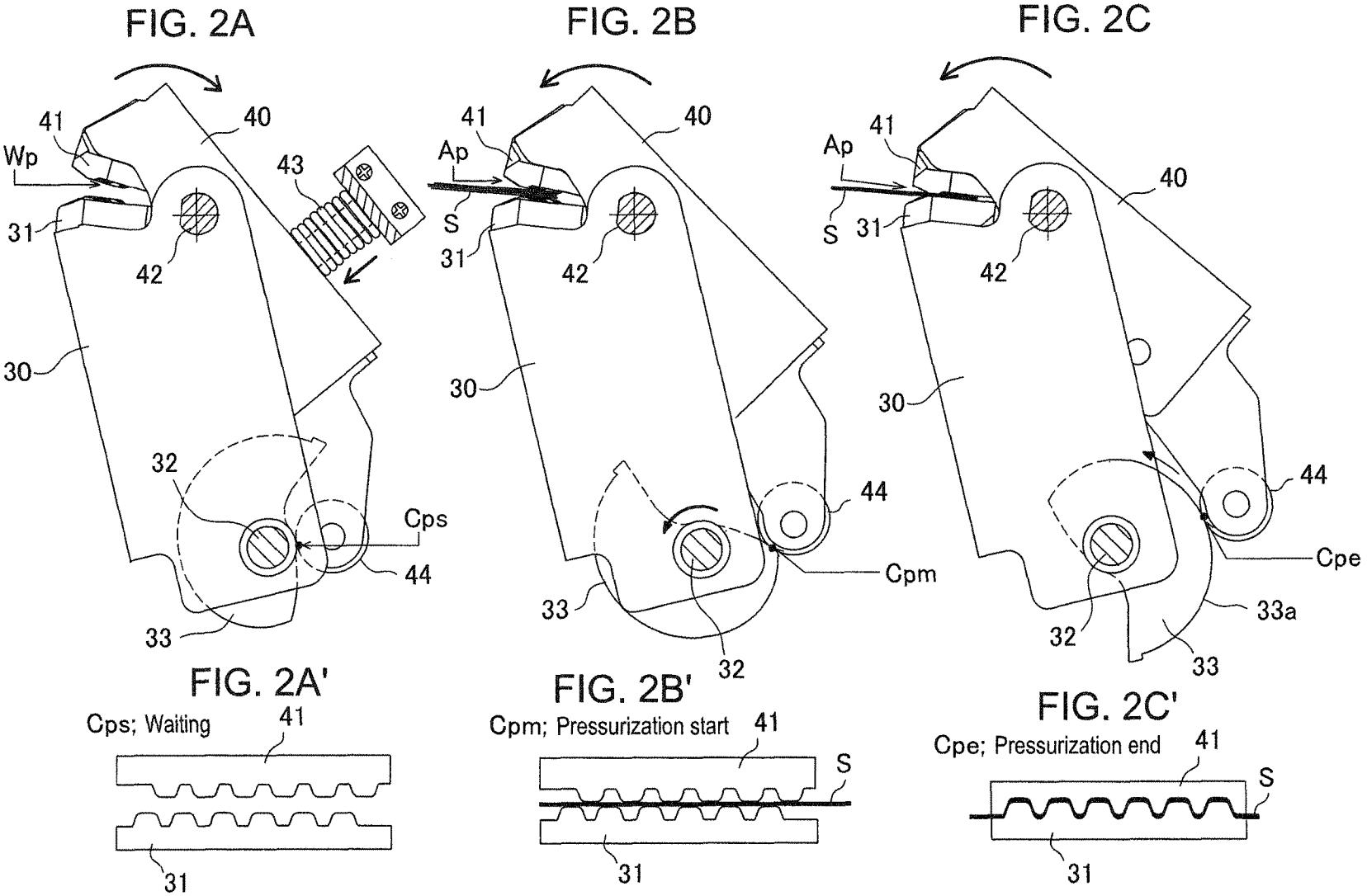

At least one of the fixed surface 31 and the movable surface 41 has a projecting-and-recessed surface (surface having projection lines) so as to deform the pressurized sheet S (see FIG. 2A'). In the illustrated example, the fixed surface 31 and the movable surface 41 are each have the projecting-and-recessed surface such that the projecting portion of one of the surfaces 31 and 41 is engaged with the recessed portion of the other one thereof. The shape of the projecting-and-recessed surface is optimized so as not to damage the sheet S (by edges of the projecting-and-recessed portions) when the sheet S is pressurized and so that a plurality of overlapped sheets are deformed so as to be engaged with each other. The sheets S clamped between the projecting-and-recessed surfaces are each deformed in a gathered manner (in a wave-like manner), and the overlapped sheets S are bound.

A drive mechanism for driving the above movable member 40 will be described. In the movable member 40 swingably supported by the fixed member 30, the movable surface 41 and a cam follower 44 (hereinafter, referred to as "follower roller") are disposed at opposite side portions (leading end portion and base end portion) of the support shaft 42. A positional relationship between the movable surface 41 at the leading end portion and the follower roller at the base end portion is set such that leverage (booster mechanism) action works using the support shaft as a fulcrum.

The fixed member 30 has, at its base end portion, a cam member 33 (cylindrical cam, in the illustrated example). The cam member 33 is supported by a cam shaft 32, and the cam shaft 32 is axially supported by the fixed member 30 so as to be rotatable. The cam member 33 and the follower roller 44 are disposed so as to be engaged with each other. A rotation of a drive motor DC is transmitted to the cam shaft 32 through a transmission means 35, and the cam member 33 is rotated forward and backward with forward and backward rotation of the drive motor.

As illustrated in FIG. 1, the drive motor DC is mounted to the unit frame 46. A rotation of a drive shaft 36 is transmitted to the cam shaft 32 through transmission gears G2, G3, G4, and G5 constituting the transmission means 35. The cam member 33 is rotated by a gear G1 connected to the cam shaft 32 in a counterclockwise direction in FIG. 1. In the illustrated example, the cam member 33 is configured to repeat a counterclockwise rotation (CCW) and a clockwise rotation (CW) in a predetermined angle range according to the forward and backward rotation of the drive motor DC. A cam surface 33*a* of the cam member 33 brings the follower roller 44 and the movable member 40 integrally formed with the follower roller 44 into swinging motion about the support shaft 42.

In the drive mechanism illustrated in FIG. 1, when the drive motor DC is rotated in the counterclockwise direction, the movable member 40 swings in the counterclockwise direction about the support shaft 42, thereby moving the movable surface 41 from the waiting position Wp to the pressurizing position Ap (state illustrated in FIG. 1). The cam surface 33*a* has a non-engagement portion Cps (FIG. 2A), where the movable member 40 is biased to the waiting position Wp by the action of the return spring without receiving the action of the cam surface 33*a*.

The drive motor DC is rotated in the clockwise direction and is stopped at a position where the non-engagement portion cps of the cam surface 33*a* and the follower roller 44 are engaged with each other. Then, the movable surface 41 is moved from the pressurizing position Ap to the waiting position Wp by spring force of the return spring 43 and is stopped at this position.

At "Cps (Cam Press Start)" position illustrated in FIG. 2A, the cam surface 33*a* holds the movable surface 41 at the waiting position Wp without acting swinging force on the follower roller 44. At "Cpm (Cam Press Middle)" position illustrated in FIG. 2B, the cam surface 33*a* applies acting force to the follower roller 44 so as to swing the movable member 40 in the counterclockwise direction. In the vicinity of the Cpm position (this position differs depending on a thickness of the sheet bundle), the movable surface 41 starts pressurizing the sheets S. At "Cpe (Cam Press End)" position illustrated in FIG. 2C, a maximum pressurizing force is applied (although this position differs depending on a thickness of the sheet bundle) to the sheets S, and then the pressurization is ended. Thereafter, along with the clockwise rotation of the cam member 33, the cam surface 33*a* is returned from the "Cpe" position, through "Cpm" position to "CPs" position.

When the cam surface 33*a* to be engaged with the follower roller 44 is situated at the "Cps" position, the movable surface 41 is situated at the waiting position separated from the fixed surface 31 as illustrated in FIG. 2A'; when the cam surface 33*a* is situated at the "Cpm" position, the movable surface 41 is situated at a pressurizing start position where pressurization of the sheets S is started, as illustrated in FIG. 2B'; and when the cam surface 33*a* to be engaged with the follower roller 44 is situated at the "Cpe" position, the movable surface is situated at a pressurizing end position where pressurization of the deformed sheet bundle S is ended, as illustrated in FIG. 2C'.

The cam surface 33*a* is formed into a "helical" shape so as to gradually increase pressurizing force while the movable surface 41 is moved from the position (Cpm) where the movable surface 41 starts pressurizing the sheet bundle S to the pressurizing end position. This is for the purpose of applying substantially the same pressurizing force even if the thickness of the sheet bundle S to be clamped between the fixed surface 31 and the movable surface 41 is changed.

That is, when the thickness of the sheet bundle S is small, a rotation angle of the cam is increased, and when the thickness of the sheet bundle S is large, the rotation angle is reduced, whereby the pressurizing force to be applied to the sheet S is made substantially uniform. For the rotation angle control, the drive motor DC may be subjected to constant torque control (constant current control). In the present invention, the cam member 33 is not limited to the illustrated cylindrical cam, but may be a plate cam. Further, in place of the cam mechanism, a force control mechanism such as a pressurizing spring may be used.

Figure 3A:
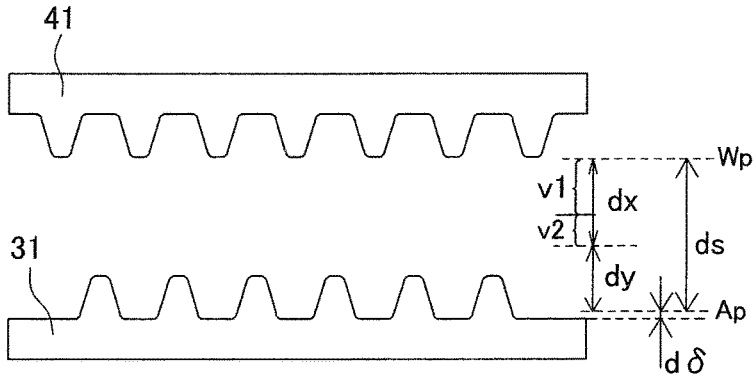
Figure 3B:
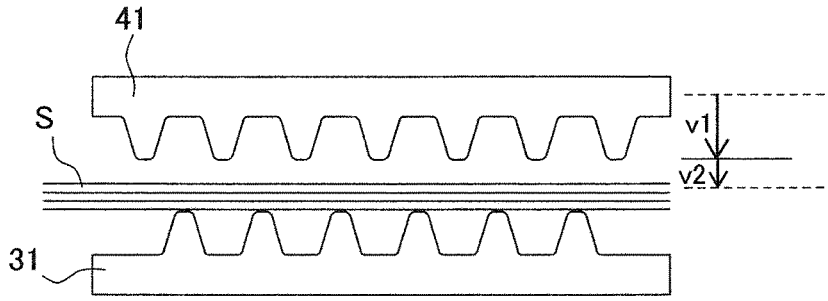
Figure 3C:
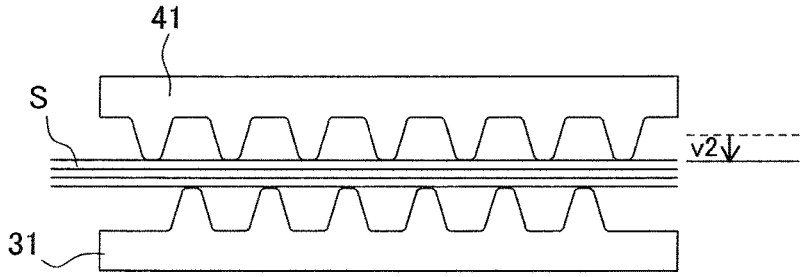
Figure 3D:
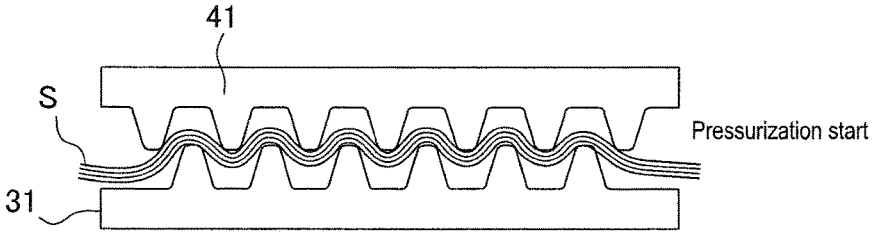
Figure 3E:
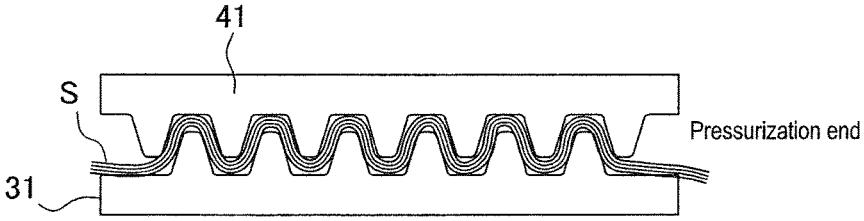

Control of the drive mechanism PM will be described according to FIGS. 3A to 3E and 4A to 4C. FIGS. 3A to 3E are explanatory views for explaining a moving stroke of the movable surface 41. FIG. 3A illustrates a state where the movable surface 41 is moved from the waiting position Wp at a first setting velocity v1, FIG. 3B illustrates a state where the moving velocity of the movable surface 41 is reduced from the first setting velocity v1 to a second setting velocity v2, FIG. 3C illustrates a state where the movable surface 41 is engaged with the sheets S at the second setting velocity v2, FIG. 3D illustrates a state where the movable surface 41 starts pressurizing the sheets S, and FIG. 3E illustrates a state where the movable surface 41 pressurizes the sheets S at a predetermined pressure (predetermined load torque).

As illustrated in FIG. 3A to 3E, the movable surface is accelerated from a stationary state at the waiting position Wp until it reaches the first setting velocity v1 (FIG. 3A) and is then decelerated to the prescribed second setting velocity v2 (FIG. 3B). Then, the movable surface 41 is engaged with the sheets S at the second setting velocity v2 (FIG. 3C). The second setting velocity v2 influences impact force that the movable surface 41 applies to the sheets S. That is, when the moving velocity is high, the impact force is large, while when the moving velocity is low, the impact force is small.

The first setting velocity v1 is set to a comparatively high velocity so that the binding processing is executed rapidly. When the movable surface 41 is engaged with the sheets S at this first setting velocity v1, it deforms the sheets with large impact force. At this time, a variation occurs in the degree of deformation of the sheet S caused by the large impact force.

That is, in one sheet bundle, several sheets positioned at an upper layer to be engaged with the movable surface 41 are deformed, and in another sheet bundle, only top one sheet to be engaged with the movable surface 41 is deformed. Therefore, a variation occurs in the subsequent pressurizing action of the movable surface 41. The second setting velocity v2 (v1>v2; velocity v2 is sufficiently smaller than the velocity v1) is set to a velocity at which the variation in the pressurizing action of the movable surface 41 is not caused.

As illustrated in FIGS. 3A and 3B, the movable surface is moved from the waiting position Wp to the pressurizing position Ap at which it is engaged with the sheets S. A maximum stroke ds of the movable surface 41 is set to an interval between the movable surface 41 situated at the waiting position Wp and the fixed surface 31. A timing at which the movable surface 41 is decelerated from the first setting velocity v1 to the second setting velocity v2 is previously set (as a design value).

The deceleration timing from the velocity v1 to velocity v2 is set to when the movable surface 41 reaches a maximum bundle thickness position (FIG. 3A; dy) of the sheet bundle and is measured based on, e.g., encoder pulse count from an encoder En. In FIG. 3A, dx, which is obtained by (ds−dy), indicates a moving amount of the movable surface 41 when it moves to an allowable maximum bundle thickness position, and dδ indicates an allowable minimum bundle thickness position at which the binding processing can be performed.

Then, the movable surface 41 gradually pressurizes the sheet bundle S as illustrated in FIG. 3D to deform the same. This deformation is executed by constant torque control (to be described later) for the drive motor DC. As described later, a previously set current value (peak current) is applied to the drive motor DC. When the predetermined current value continues to be applied to the drive motor DC, the movable surface 41 stops after deforming the sheets S into a predetermined shape as illustrated in FIG. 3E. Then, the movable surface 41 maintains a state of applying predetermined pressurizing force to the sheet bundle S (pressurization holding state). When the movable surface 41 pressurizes the sheet bundle S for a set pressurizing time, a controller 50 to be described later moves the movable surface 41 from the pressurizing position Ap to the waiting position Wp after elapse of a set pressurizing time T.

Figure 4A:
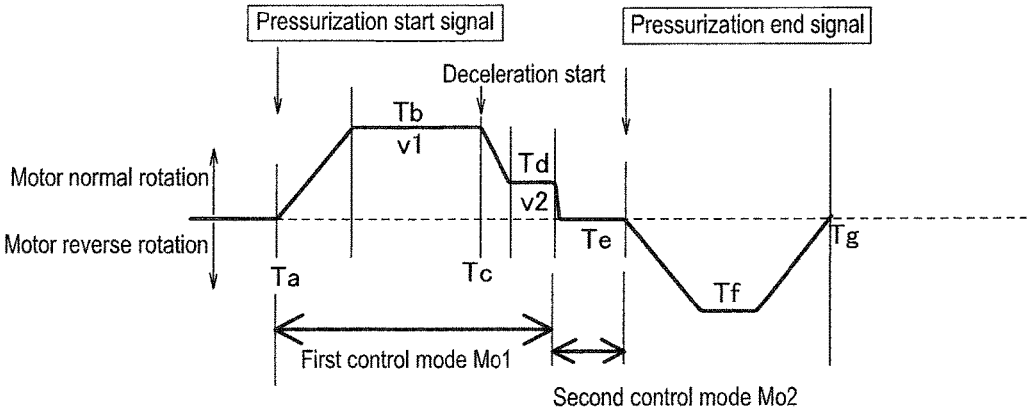
Figure 4B:
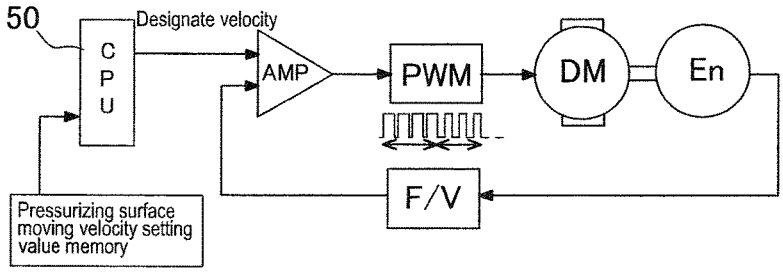
Figure 4C:
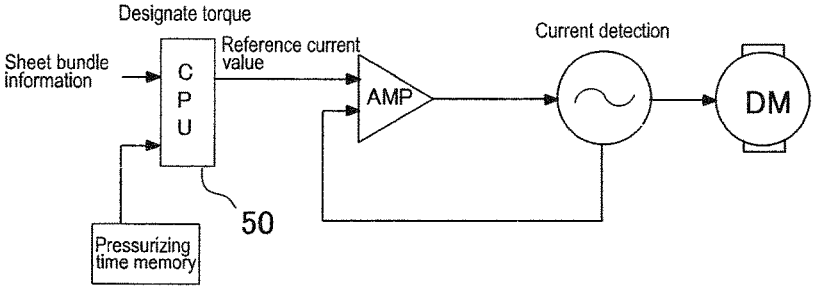

FIGS. 4A to 4C are explanatory views of control for the drive motor DC. FIG. 4A is a velocity diagram of the movable surface 41, FIG. 4B is a conceptual view of velocity control for the drive motor DC, and FIG. 4C is a conceptual view of torque control for the drive motor DC. In FIG. 4A, the movable surface 41 starts the pressurizing operation (binding operation) at the waiting position Wp (Ta in FIG. 4A), and then the velocity of the movable surface 41 is increased to the first setting velocity v1 (Tb in FIG. 4A). Then, when a predetermined operation time (Time 1) is reached, the velocity of the movable surface 41 starts to be reduced to the second setting velocity v2 (Tc in FIG. 4A). When the velocity of the movable surface 41 reaches the second setting velocity v2 (Td in FIG. 4A), the movable surface 41 is engaged with the sheets S while keeping the second setting velocity v2. Then, the movable surface 41 maintains a state of pressurizing the sheets S for a time specified by the controller 50 (Te in FIG. 4A).

Thereafter, the controller 50 reverses the drive motor DC after elapse of a pressurizing time to be described later. Then, the movable surface 41 starts moving in an opposite direction (direction separated from the fixed surface) (Tf in FIG. 4A). Then, after reaching a predetermined velocity, the movable surface 41 is decelerated and stops at the waiting position Wp (Tg in FIG. 4A).

Next, velocity control (FIG. 4B) and torque control (FIG. 4C) for the drive motor DC performed by the controller 50 will be described. The drive motor DC is a DC (Direct Current) motor. The controller 50 to be described later controls the DC motor in a first control mode Mo1 to control the velocity of the movable surface 41 during the movement of the movable surface 41 from the waiting position Wp to the position at which the movable surface 41 is engaged with the sheets S and then controls a torque of the drive motor DC to be transmitted to the movable surface in a second control mode Mo2 after engagement between the movable surface 41 and the sheets S.

The concept of the [first control mode] is as follows. That is, as illustrated in FIG. 4B, the controller 50 calls the first setting velocity v1 and the second setting velocity v2 previously set and stored in a storage means (RAM) 54. Then, the controller 50 activates the drive motor DC upon reception of a signal indicating that the sheet bundle S is set on the fixed surface 31 and controls the drive motor DC so as to control the velocity of the movable surface to the first setting velocity v1. This control is achieved by controlling voltage to be supplied to the drive motor DC based on a result of comparison between a detection value (displacement per unit time) of an encoder En (rotation amount detection means) that detects a rotation frequency of the drive shaft 36 and a velocity reference value. In FIG. 4B, PWM control is exemplified as the voltage control.

Then, the controller 50 controls the velocity while changing a duty ratio of the voltage to be supplied to the drive motor DC based on the signal from the encoder En. As another method, there can be adopted a circuit configuration that applies a predetermined voltage value (voltage value corresponding to each of the velocity v1 and velocity v2) to the motor without performing the PWM control. In this case, voltage (potential difference) of the motor is detected, and the detected voltage and a reference value are compared. Thus, "first control for the pressurizing surface (movable surface 41) to be engaged with the sheets at the setting velocity (second setting velocity v2)" is executed by execution of the first control mode Mo1.

The concept of the [second control mode] is as follows. That is, as illustrated in FIG. 4C, the controller 50 calls a pressurizing force Fp (load torque) and a pressurizing time Tp previously set and stored in the storage means (RAM) 54. Then, the controller 50 sets the pressurizing force Fp of the movable surface 41 and the pressurizing time Tp based on information of the sheet bundle S. In the illustrated device, the pressurizing force Fp is set as a design value, and the pressurizing time Tp is changed according to a parameter to be described later. Alternatively, the pressurizing force Fp is set at a plurality of levels in accordance with the bundle thickness of the sheet bundle and/or a sheet material. Further alternatively, the pressurizing force Fp is set by an operator based on finish quality.

For example, when the thickness of the sheet bundle S is equal to or more than a predetermined thickness, the pressurizing force Fp is set to a large pressurizing force Fp1; on the other hand, when the thickness is less than the predetermined thickness, the pressurizing force Fp is set to a small pressurizing force Fp2. Further, when a sheet material is stiff, the pressurizing force Fp is set to the large pressurizing force Fp1; on the other hand, when the sheet material is fragile, the pressurizing force Fp is set to the small pressurizing force Fp2. Further, when a strong binding state is required, the pressurizing force Fp is set to the large pressurizing force Fp1; on the other hand, when a binding state at a level where the sheets S can easily be separated from each other is required, the pressurizing force Fp is set to the small pressurizing force Fp2.

The controller 50 compares a reference current value corresponding to the set pressurizing force Fp and a detection value from a current detection means (circuit) 52 that detects counter electro-motive force of the drive motor DC and performs control, based on a result of the comparison, such that the set current value is supplied to the motor. At an initial stage of the second control mode Mo2, "second control for the pressurizing surface 41 to pressurize the sheets with a set torque" is executed.

[Pressurizing Time]

The controller 50 sets the pressurizing time Tp in accordance with a state of the sheet bundle S to be bound. In order to plastically deform the sheets when the sheets are pressurized and deformed so as to be engaged with each other for binding, a sufficient pressurizing time is required. When the pressurizing time Tp is set long, the sheets are deformed so as to be surely engaged with each other, and the engagement state is maintained; on the other hand, when the pressurizing time Tp is set short, the sheets are not deformed to such a degree that they are engaged with each other, or the sheets are restored to their original shape.

In the illustrated device, the pressurizing time is determined based on at least one of the following parameters: (1) bundle thickness; (2) number of sheets; and (3) sheet material. When the thickness of the sheet bundle is large, a deformation amount of the sheet bundle is reduced in proportion of the thickness (due to influence of a volume of the sheets to be deformed), and when the number of the sheets S is large, the deformation amount is reduced in proportion of the number of the sheets (due to influence of an air layer between the sheets). Further, when the sheet material is stiff, the deformation amount is smaller than in a case where the sheet material is fragile. Thus, the pressurizing time Tp is set long under the condition where the sheet bundle is difficult to deform. At an end stage of the second control mode Mo2, "third control for the pressurizing surface 41 to continue pressurizing the sheets with a predetermined set torque" is executed.

[Control Configuration]

Figures 5A, 5B:
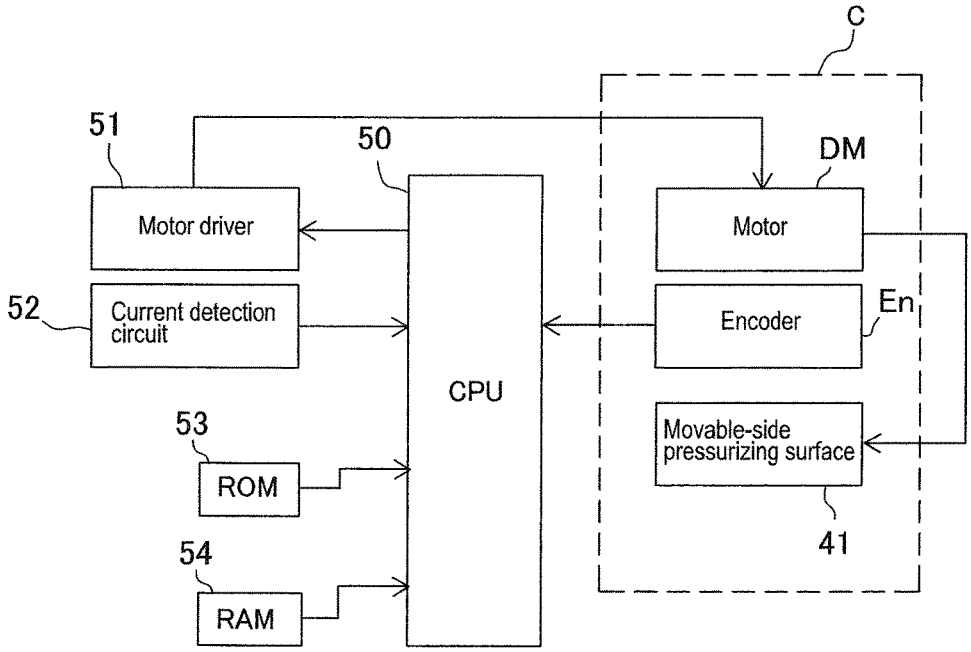
FIGS. 5A and 5B are a block diagram illustrating a control configuration of the device illustrated in FIG. 1 and an example of a data table stored in an RAM provided in a controller, respectively.

A control configuration will be described with reference to FIGS. 5A and 5B. FIG. 5A is a block diagram illustrating a control configuration. A controller (CPU) 50 controls a motor driver 51 of a drive motor DM. To this end, a detection value (output value of an encoder sensor) of an encoder En which is mounted to the drive shaft 36 for execution of the above-mentioned first control mode Mo1 is transmitted to the control CPU 50. Further, in order to execute the above-mentioned second control mode Mo2, the control CPU 50 is provided with a current detection circuit that detects a current value of the drive motor DC. Further, the control CPU 50 is provided with a ROM 53 and a RAM 54. The RAM 54 stores therein a data table to be described below.

FIG. 5B illustrates an example of the data table stored in the RAM 54 provided in the controller (CPU) 50. In a memory area of the RAM 54, data of the parameters: sheet bundle thickness (X), number of sheets (Y), and sheet material (Z) are stored. A plurality of levels (segment A and segment B) are set for each parameter, and the pressurizing time Tp within which the sheet bundle can be surely bound under each condition is set from an experimental value.

The pressurizing time Tp is set from an actual experimental position in accordance with the sheet bundle thickness and/or number of sheets and/or sheet material, and the obtained results are stored in a storage means (RAM, etc.). Based on the stored experimental values, actual pressurizing time Tp is set in accordance with the conditions of the sheets to be bound. When the pressurizing time Tp is set based on a plurality of parameters, it is set in a worst-case scenario (longest pressurizing time among a plurality of conditions is adopted).

For example, when the pressurizing time Tp is set using the parameter of "bundle thickness of the sheet bundle", (1) the bundle thickness is detected by a bundle thickness detection means (sensor means) disposed in a moving area of the movable surface 41 (movable surface) or (2) the bundle thickness is detected based on an output value from the current detection means 52. In the method of (2), an interval between the movable surface 41 and fixed surface 31 is calculated from a moving amount of the movable surface 41 from the waiting position Wp to a current detection position at which the movable surface 41 is engaged with the sheets S. (3) Further, when there is provided a means for counting the number of sheets constituting the sheet bundle, the bundle thickness is calculated from the counted number of the sheets (number of sheets× thickness per one sheet).

Further, when the pressurizing time Tp is set using the parameter of "number of sheets constituting the sheet bundle", the number of sheets is counted by a accumulating section for accumulating the sheet bundle or (2) the number of sheets is acquired by acquiring sheet number information that an operator has set in an upstream-side device (e.g., image forming device) from which the sheets are delivered. Further, when the pressurizing time Tp is set using the parameter of "sheet material", (1) the sheet material is input by an operator, or (2) the operator specifies a sheet type from among a plurality of previously set sheet types such as normal paper, coated paper, and Japanese paper.

[Binding Processing Flow]

Figure 6:
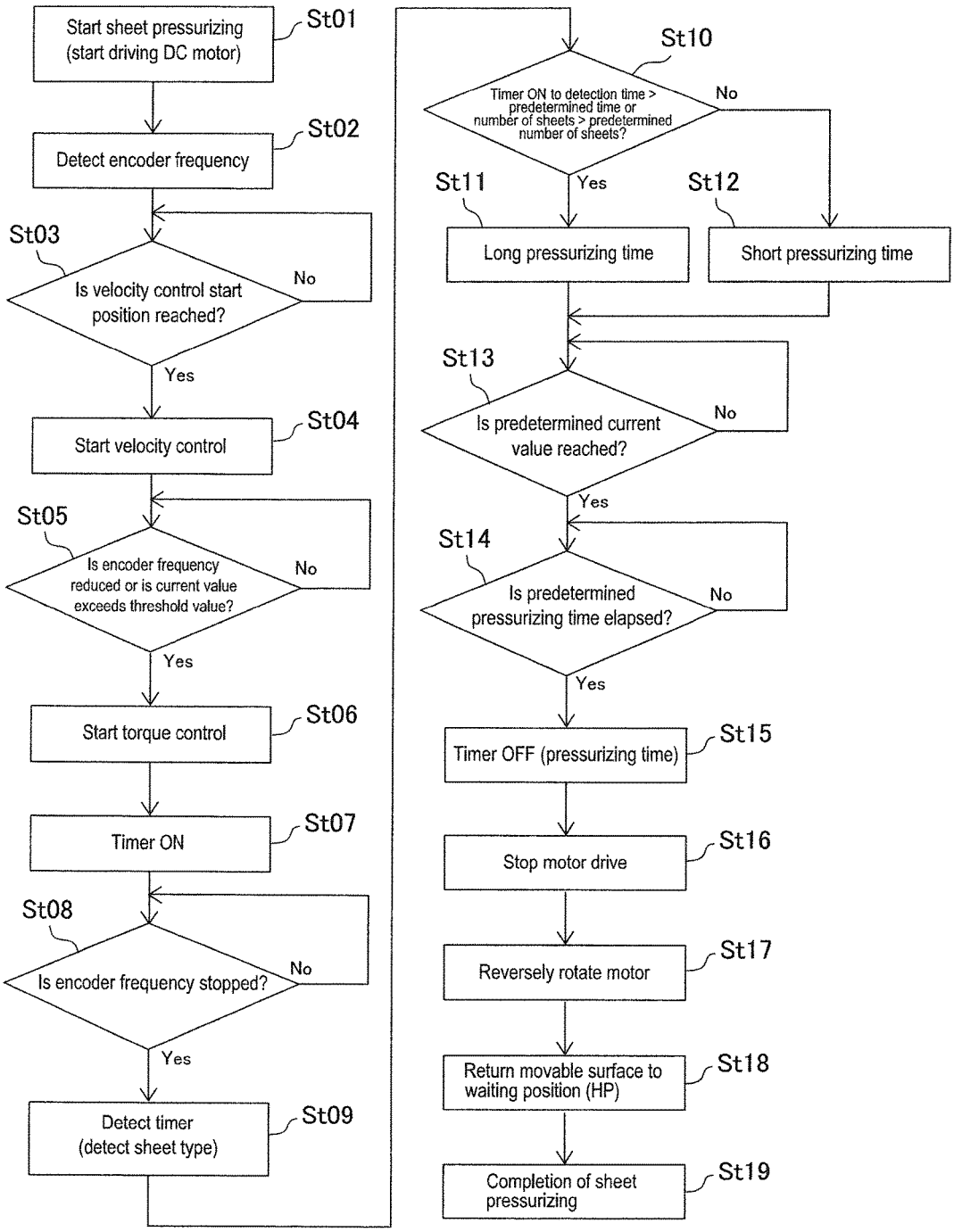
FIG. 6 is a flowchart illustrating a procedure of sheet binding processing performed in the device illustrated in FIG. 1.

A procedure of the binding processing will be described with reference to FIG. 6. The controller 50 detects a binding ready state where the sheet bundle S is situated at a binding position by using, e.g., a sheet presence/absence sensor and issues a processing signal to a binding unit C. Upon receiving the signal, the controller 50 activates the drive motor DC (St 01). The activation control of the drive motor DC is executed in the above-mentioned first control mode Mo1. A voltage corresponding to the previously set first setting velocity v1 is applied to the drive motor DC. Then, the controller 50 counts an encoder signal from the encoder En (St02). When a predetermined count number is reached, the controller 50 reduces the voltage to be supplied to the drive motor DC for deceleration (St03). Then, the controller 50 maintains rotation of the drive motor DC in a state where the drive motor DC reaches the predetermined second setting velocity v2 (St04).

Then, the controller 50 determines whether or not the movable surface 41 is moved to the engagement position with the sheet bundle S and starts pressurizing the sheet bundle S. When making this determination based on the detection value of the current detection means (circuit) 52, the controller 50 determines the start of pressurization at a displacement point at which the detection value rises (St05).

After the movable surface 41 is engaged with the sheet bundle S, the controller 50 shifts to the second control mode Mo2 (torque control) to control the current value of the drive motor DC. Then, the drive motor DC is rotated until a load torque acting on the drive shaft 36 reaches a predetermined value. After the load torque reaches the predetermined value, the drive motor DC maintains the predetermined load torque value (St06).

Then, the controller 50 activates a pressurizing timer (time counting means) upon determination (St05) of the engagement state of the movable surface 41 with the sheets S and measures a time (St07 to St16). The time counting means is, e.g., a CPU counter, and when the measured time reaches the above-mentioned pressurizing time Tp (time 01 to time 06 of FIG. 5B, the controller 50 reversely rotates the drive motor DC (St17). Then, when the movable surface 41 is returned to the waiting position (home position) Wp (St18), the controller 50 stops the drive motor DC based on a signal from a position sensor and then ends the binding processing (St19).

For achieving the above operation, the drive motor DC is provided with the encoder En and the current detection circuit 52. Further, although a plurality of levels (segment A and segment B of FIG. 5B) are set for the pressurizing time Tp, the only a single level may be set therefor. Further alternatively, the pressurizing time Tp may be calculated by arithmetic operations.

[Post-Processing Method]

Next, a binding method according to the present invention will be described. As described above, the present invention is featured in that the pressurizing time of pressurizing the sheet bundle using the pressurizing means (pressurizing members 30 and 40) is controlled when the sheet bundle S is pressurized and deformed by the pressurizing members 30 and 40 so as to be engaged with each other for binding.

In a process of positioning the sheet bundle S at a predetermined binding position, in a post-processing device B to be described later, image-formed sheets are positioned at a binding position of a processing tray 24. In a process of pressurizing the sheet bundle S for a predetermined time using the movable surface 41 of the pressurizing means 30 and 40 disposed at the binding position, in the binding unit C, the movable surface 41 is moved from the waiting position (non-pressurizing position) Wp to the pressurizing position Ap to pressurize the sheet bundle S.

In the above pressurizing process, the pressurizing time Tp of pressurizing the sheet bundle S by the movable surface 41 is changed depending on conditions of the sheet bundle to be bound.

When the thickness of the sheet bundle S is large, when the number of the sheets constituting the sheet bundle is large, or when the material of the sheets constituting the sheet bundle is high in strength (stiff), the pressurizing time Tp is set long.

[Post-Processing Device]

Figure 7:
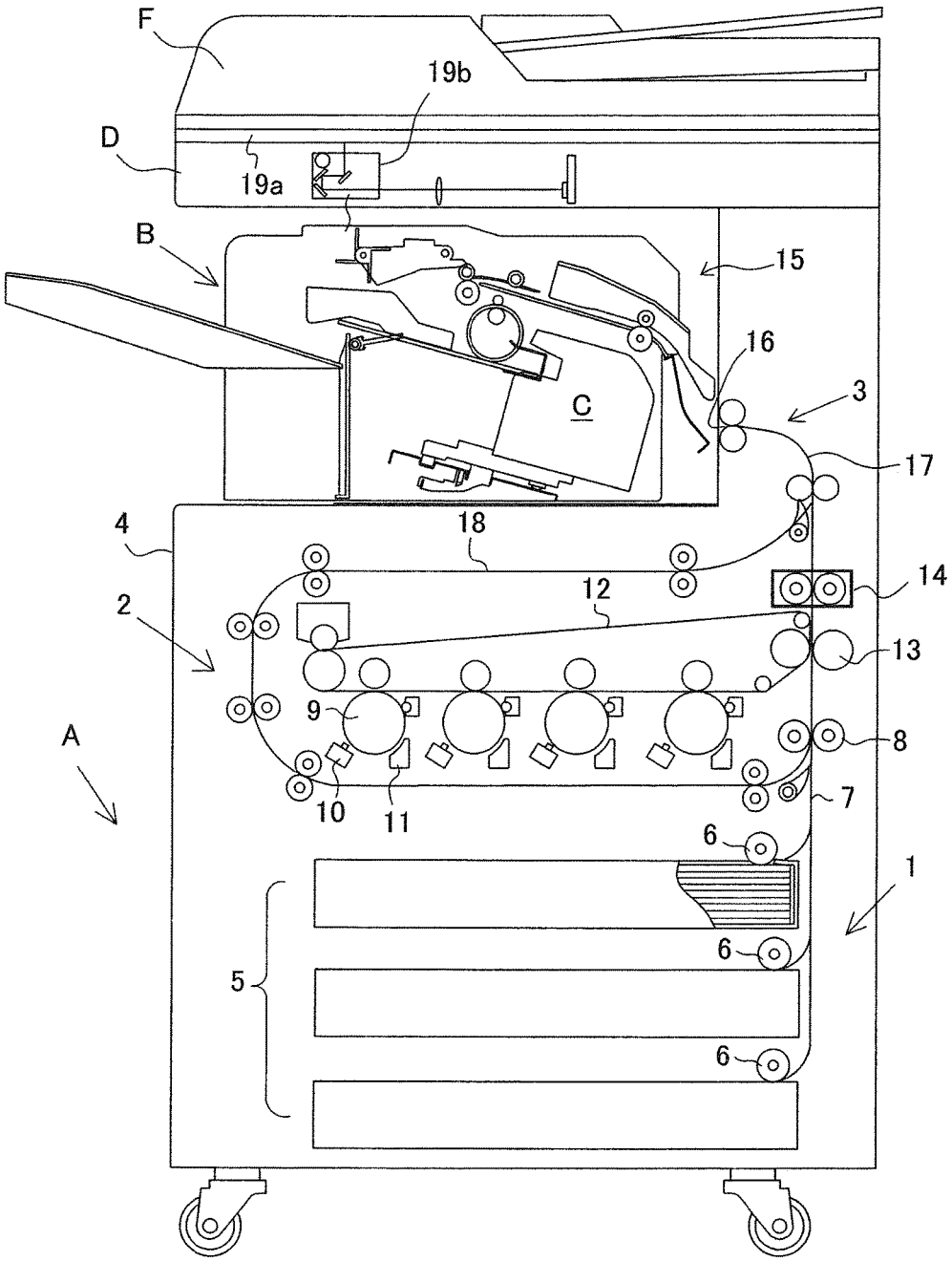
FIG. 7 is an explanatory view of an image forming system incorporating the device illustrated in FIG. 1.

Next, the post-processing device B illustrated in FIGS. 7 and 8 will be described. The illustrated post-processing device B incorporates the binding unit C and is configured as a terminal device of an image forming system A to be described later.

Figure 8:
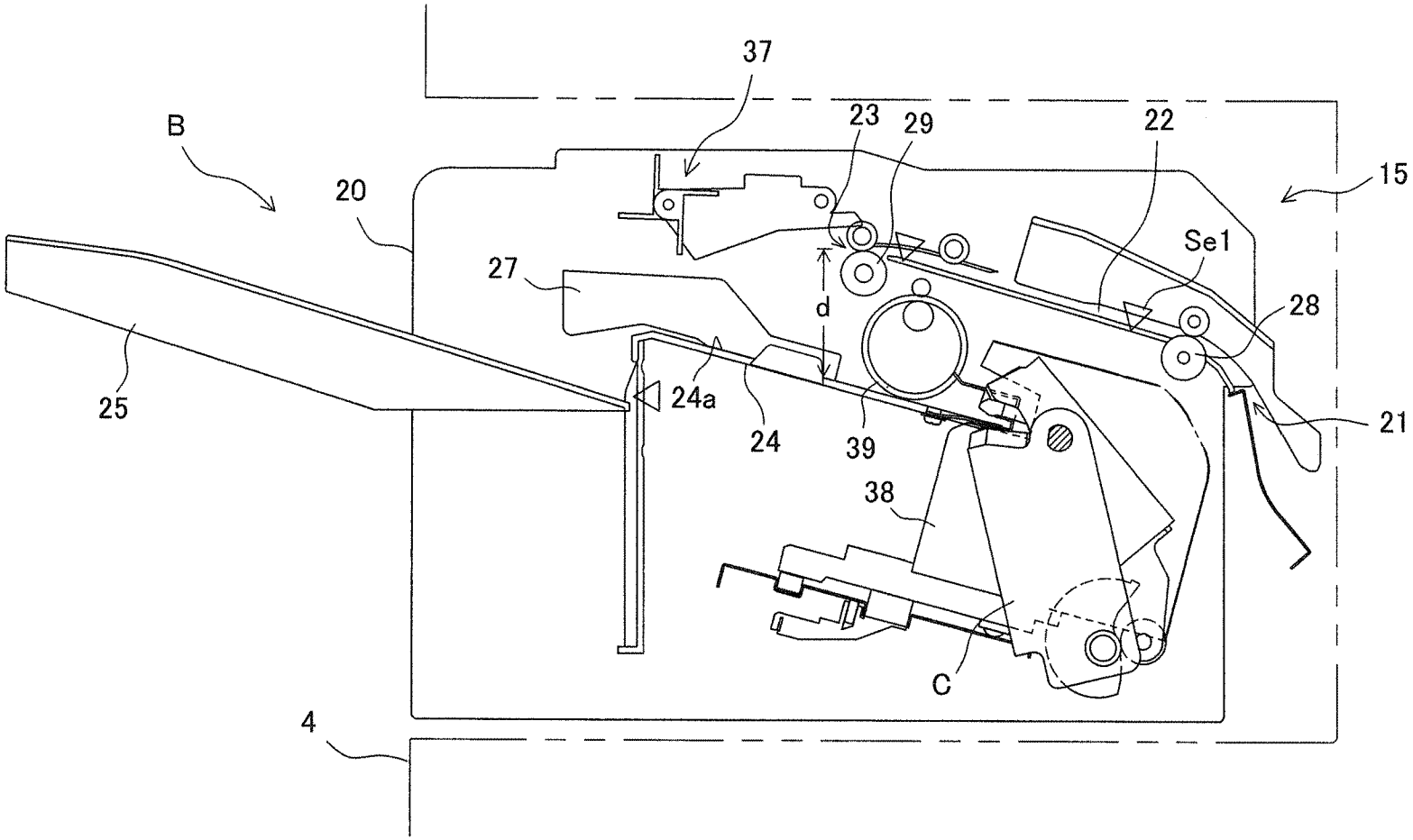
FIG. 8 is an explanatory view of an entire configuration of a post-processing device constituting the image forming system illustrated in FIG. 7.

As illustrated in FIG. 8, the post-processing device B includes a device housing 20, a sheet conveying path 22 disposed in the housing, a processing tray 24 disposed downstream of a discharge port 23 provided at an end of the sheet conveying path 22, and a stack tray 25 disposed downstream of the processing tray 24.

There are provided, in the processing tray 24, a carry-in means 37 for carrying in the sheet, a sheet regulation means (regulation stopper) 26 for accumulating the carried-in sheets, and an aligning means 27. There are further provided, in the processing tray 24, a staple binding means 38 for staple-binding the sheet bundle S and the binding unit C that binds the sheet bundle without stapler.

In the device housing 20, there is provided the sheet conveying path 22 having a carry-in port 21 and a sheet discharge port 23 as illustrated in FIG. 8. The illustrated sheet conveying path 22 receives the sheet fed horizontally thereto, conveys the sheet in a substantially horizontal direction, and carries out the sheet through the sheet discharge port 23. The sheet conveying path 22 incorporates a conveying mechanism (conveying roller, etc.) that conveys the sheet.

The conveying mechanism includes conveying roller pairs arranged at an interval set in accordance with a path length. A carry-in roller pair 28 is disposed near the carry-in port 21, and a discharge roller pair 29 is disposed near the sheet discharge port 23. The carry-in roller pair 28 and the discharge roller pair 29 are connected to the same drive motor (not illustrated) and convey the sheet at the same peripheral speed. There is disposed, along the sheet conveying path 22, a sheet sensor Set that detects at least one of front and rear ends of the sheet.

The processing tray 24 is disposed downstream of the sheet discharge port 23 of the sheet conveying path 22 with a level difference d between itself and the sheet discharge port 23. The processing tray 24 is provided with a sheet placement surface 24*a* that supports at least a part of the sheet so as to allow the sheet fed from the sheet discharge port 23 to be stacked upward.

The processing tray 24 is configured to accumulate the sheets fed from the sheet discharge port 23 in a bundle, apply the binding processing after aligning the accumulated sheets into a predetermined posture, and carry out the resultant sheet bundle S to the downstream side stack tray 25.

There is provided, at the sheet discharge port 23, a sheet carry-in mechanism 37 (paddle rotating body). The sheet carry-in mechanism 37 is configured to convey the sheet to a predetermined position of the processing tray 24. There is further provided, in the processing tray 24, a raking conveying means 39 that guides the sheet front end to the regulation means 26.

The raking conveying means 39 is disposed upstream of the sheet regulation means 26. The illustrated raking conveying means 39 is formed of a ring-shaped belt member. The belt member is engaged with a topmost sheet of the sheet bundle placed on the sheet placement surface and is rotated in a direction conveying the sheet toward the regulation stopper (sheet regulation means) 26.

The sheet regulation stopper (sheet regulation means) 26 for positioning of the sheet is provided at a leading end portion (rear end of a sheet discharge direction) of the processing tray 24. The sheet carried in through the sheet discharge port 23 by the raking conveying means 39 abuts against the sheet regulation stopper 26 for regulation. The regulation stopper 26 aligns the sheets S accumulated on the processing tray at the binding position where the sheets are bound.

Further, there is provided, in the processing tray 24, a side aligning means 27 for positioning, in terms of a width direction, the sheet positioned by the regulation stopper 26 on a reference line. The side aligning means 27 aligns side edges of the sheets fed through the discharge port 23 and positioned by the regulation stopper 26 in a direction perpendicular to the sheet discharge direction.

Further, there are provided, in the processing tray 24, a staple binding device 38 (first binding means) that binds the sheets aligned by the side aligning means 27 in terms of the width direction and the above-mentioned binding unit C (second binding means).

A sheet binding mechanism and a binding processing operation of the staple binding device 38 are well known, and thus descriptions thereof will be omitted. The sheet binding mechanism and binding processing operation of the binding unit C are as described above with reference to FIGS. 1 to 5A and 5B.

[Image Forming System]

Next, an image forming system A illustrated in FIG. 7 will be described. The illustrated image forming system is constituted by an image forming device A and the above-mentioned post-processing device B. The binding unit C is incorporated in the post-processing device. Hereinafter, the image forming device will be described.

The image forming device A includes a sheet supply section 1, an image forming section 2, a sheet discharge section 3 and a signal processing section (not illustrated) and is incorporated in a device housing 4. The sheet supply section 1 includes a plurality of cassettes 5 for accommodating the sheets and is configured to accommodate the sheets of different sizes. Each cassette 5 incorporates a sheet supply roller 6 that delivers the sheets and a separating means (separating claw, or separating roller, etc. not illustrated) that separates the sheets one from another.

A sheet supply path 7 is provided in the sheet supply section 1, along which the sheet is fed from each cassette 5 to the image forming section 2. A registration roller pair 8 is provided at an end of the sheet supply path 7. The registration roller pair 8 aligns front ends of the sheets and makes the sheets wait until an image forming timing of the image forming section 2 is reached.

The image forming section 2 can employ various image forming mechanism that form an image onto the sheet. The illustrated image forming section 2 employs an electrostatic image forming mechanism. As illustrated in FIG. 7, a plurality of drums 9, each of which is formed of a photoconductor, are disposed in the device housing 4 so as to correspond to the number of color components to be used. There are provided around each drum 9 a light emitting device (laser head, etc.) 10 and a developer 11. A latent image (electrostatic image) is formed on each drum 9 by the light emitting device, and toner ink is adhered onto the formed image by the developer 11. The ink images of respective color components formed on the respective drums are transferred onto a transfer belt 12 and are then synthesized.

The transfer image formed on the belt is transferred onto the sheet fed from the sheet supply section 1 by a charger 13, fixed by a fixing device (heating roller) 14, and fed to a sheet discharge section 3. The sheet discharge section 3 includes a sheet discharge port 16 through which the sheet is carried out to a sheet discharge space 15 formed in the device housing 4 and a sheet conveying path 17 that guides the sheet from the image forming section 2 to the sheet discharge port. A duplex path 18 is continuously formed from the sheet discharge section 3, whereby the sheet with an image formed on one surface is fed to the image forming section 2 once again while being reversed.

A reference symbol D denotes an image reading unit. The image reading unit D includes a platen 19*a* and a reading carriage 19*b* that is reciprocated along the platen. A reference symbol F is a document feeding unit. The document feeding unit F includes a conveying mechanism that conveys document sheets set on a sheet supply tray one by one to the platen 19*a* and discharges the document sheet to a sheet discharge tray after image reading by the image reading unit D.

Figure 9:
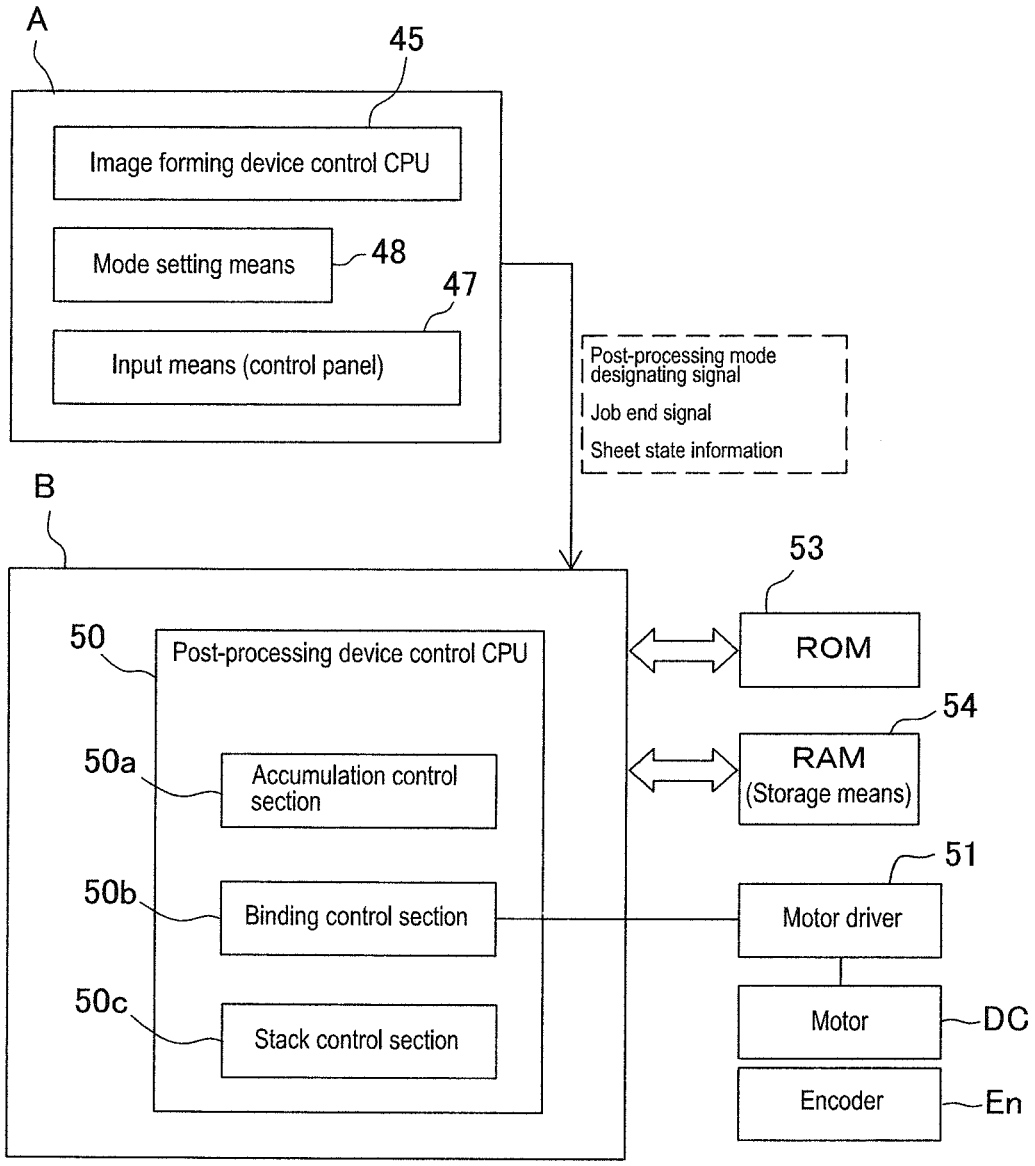
FIG. 9 is a block diagram illustrating a control configuration of the image forming system illustrated in FIG. 7.

Next, a control configuration of the image forming system will be described with reference to FIG. 9. The controller 50 includes an image forming control section 45 for controlling the image forming unit and a post-processing control section 50. The image forming control section 45 includes a mode selecting means 48 and an input means 47. The input means 47 sets an image forming condition and a binding mode. The binding mode includes a mode in which the binding processing is executed by the first binding means (staple binding device) 38 and a mode in which the binding processing is executed by the second binding means (binding unit) C.

The post-processing control section 50, which includes a post-processing control CPU, calls an execution program stored in the ROM 53 and executes post-processing operation. The RAM 54 stores control data such as the pressurizing time Tp of the binding operation performed in the second binding means C.

Te control CPU 50 includes an accumulation control section 50*a*, a binding control section 50*b*, and a stack control section 50*c*. The accumulation control section 50*a* accumulates and aligns the sheets fed from the image forming unit A on the processing tray 24. The binding control section 50*b* control the staple binding device 38 to perform the binding operation when the first binding mode is selected. On the other hand, when the second binding mode is selected, the binding control section 50*b* control the binding unit C to perform the binding operation.

The pressurizing time Tp is controlled based on the parameters: "bundle thickness", "number of sheets", and "sheet material" in the above embodiment. However, the pressurizing time Tp may be input by an operator through the input means 47 (operation panel).

In such a case, the operator inputs, through the operation panel, "pressurizing time Tp <long>" or "pressurizing time Tp <short>" based on conditions such as "sheet material", "finish quality", and the like.

Incidentally, this application claims priority from Japanese Patent Applications No. 2014-078604 and No. 2014-078605, the entire contents of which are incorporated herein as reference.

What is claimed is:

1. A sheet binding device comprising:

a pressurizing unit that pressurizes a sheet bundle by a pressurizing section to bind the sheet bundle, the pressurizing section being configured to be moved from a waiting position separated from a sheet bundle to a pressurizing position at which the pressurizing section pressurizes the sheet bundle;

a drive motor that actuates the pressurizing unit so that the pressurizing section is moved from the waiting position to the pressurizing position; and a controller that controls a rotational speed of the drive motor based on a detection of a rotation of the drive motor such that the pressurizing section is engaged with a sheet bundle at a predetermined setting velocity.

2. The sheet binding device according to claim 1, wherein the controller controls the drive motor such that the pressurizing section pressurizes a sheet bundle at a predetermined setting torque after being engaged with the sheet bundle.

3. The sheet binding device according to claim 1, wherein the setting velocity is set a velocity at which the pressurizing section does not apply force equal to or larger than a predetermined value to a sheet bundle when being engaged with the sheet bundle.

4. The sheet binding device according to claim 1, wherein the controller includes, as a control mode, a first control mode that controls voltage to be supplied to the drive motor and a second control mode that controls current to be supplied to the drive motor, and the controller controls the drive motor in the first control mode during movement of the pressurizing section from the waiting position to an engagement position with a sheet bundle and controls the drive motor in the second control mode after the pressurizing section is engaged with a sheet bundle.

5. The sheet binding device according to claim 4, wherein the controller includes a determination unit that determines whether or not the pressurizing section is being engaged with a sheet bundle, and the controller switches the control mode from the first control mode to the second control mode depending on a result of the determination from the determination unit.

6. The sheet binding device according to claim 5, wherein the determination unit determines whether or not the pressurizing section is being engaged with a sheet bundle depending on a detection value from a unit that detects current of the drive motor.

7. The sheet binding device according to claim 1, wherein the controller can change the setting velocity in accordance with a material of sheets constituting a sheet bundle or a thickness of the sheet bundle.

8. The sheet binding device according to claim 1, wherein the controller can change a setting torque in accordance with a material of sheets constituting a sheet bundle or a thickness of a sheet bundle.

9. The sheet binding device according to claim 1, wherein the controller includes an input unit, and at least one of the setting velocity and a setting torque can be changed according to input information from the input unit.

10. The sheet binding device according to claim 1, further comprising:

a rotation amount detection unit that detects a rotation amount of the drive motor;

a current detection unit that detects current of the drive motor; and a time counting unit that counts a time, wherein the controller is configured to execute a first control to make the pressurizing section be engaged with a sheet bundle at the setting velocity, a second control to make the pressurizing section pressurize a sheet bundle at a setting torque, and a third control to make the pressurizing section maintain a state of pressurizing a sheet bundle at the setting torque for a predetermined setting time period, and the first control, second control, and third control the drive motor based on a detection value of the rotation amount detection unit, the current detection unit, and the time counting unit, respectively.

11. A post-processing device comprising:

a sheet accumulating unit that accumulates sheets fed from an upstream side at a predetermined binding position; and a sheet binding unit that is provided in the sheet accumulating unit and configured to bind sheets, wherein the sheet binding unit is the sheet binding device as claimed in claim 1.

12. An image forming system comprising:

an image forming unit that forms an image onto a sheet; and a post-processing unit that accumulates sheets fed from the image forming unit and binds the sheets, wherein the post-processing unit is the post-processing device as claimed in claim 11.

* * * * *